US007202759B2

(12) United States Patent
Blacka

(10) Patent No.: US 7,202,759 B2
(45) Date of Patent: Apr. 10, 2007

(54) WIDEBAND TEMPERATURE-VARIABLE ATTENUATOR

(75) Inventor: Robert J. Blacka, Pennsauken, NJ (US)

(73) Assignee: Smith Interconnect Microwave Components, Inc., Stuart, FL (US)

( * ) Notice: Subject to any disclaimer, the term of this patent is extended or adjusted under 35 U.S.C. 154(b) by 74 days.

(21) Appl. No.: 10/912,726

(22) Filed: Aug. 5, 2004

(65) Prior Publication Data

US 2006/0028289 A1 Feb. 9, 2006

(51) Int. Cl.
*H01P 1/22* (2006.01)

(52) U.S. Cl. ..... 333/81 A; 338/216

(58) Field of Classification Search ..... 333/81 A, 333/81 R; 338/22 R, 216
See application file for complete search history.

(56) References Cited

U.S. PATENT DOCUMENTS 5,332,981 A * 7/1994 Mazzochette et al. .... 333/81 R
6,081,728 A * 6/2000 Stein et al. ..... 455/523

FOREIGN PATENT DOCUMENTS

JP 2002208803 A * 7/2002

* cited by examiner

*Primary Examiner*—Stephen E. Jones
(74) *Attorney, Agent, or Firm*—Morgan, Lewis & Bockius LLP

(57) ABSTRACT

An absorptive temperature-variable microwave attenuator is produced using a first plurality of shunt resistors separated by quarter-wave transmission lines connected by a series resistor with a second plurality of shunt resistors separated by quarter-wave transmission lines. At least one or more of the resistors are temperature-variable resistors. The temperature coefficients of the temperature-variable resistors are selected so that the attenuator changes at a controlled rate with changes in temperature while attenuator remains relatively matched to the transmission line. In one embodiment, the resistors are thick-film resistors and a variety of temperature coefficients can be created for each resistor by properly selecting and mixing different inks when forming the thick film resistors. Furthermore, attenuators can be created having either a negative temperature coefficient of attenuation or a positive temperature coefficient of attenuation.

18 Claims, 2 Drawing Sheets

WIDEBAND TEMPERATURE-VARIABLE ATTENUATOR

BACKGROUND OF THE INVENTION

1. Field of the Invention

The invention relates to temperature-variable microwave attenuators.

2. Description of the Related Art

Attenuators are used in applications that require signal level control. Level control can be accomplished by either reflecting a portion of the input signal back to its source or by absorbing some of the signal in the attenuator itself. The latter is often preferred because the mismatch which results from using a reflective attenuator can create problems for other devices in the system such as nonsymmetrical two-port amplifiers. It is for this reason that absorptive attenuators are more popular, particularly in microwave applications. The important parameters of an absorptive attenuator are: attenuation as a function of frequency; return loss; and stability over time and temperature.

It is known that variations in temperature can affect various component parts of a microwave system causing differences in signal strengths at different temperatures. In many cases, it is impossible or impractical to remove the temperature variations in some Radio Frequency (RF) components. For example, the gain of many RF amplifiers is temperature dependent. In order to build a system with constant gain, a temperature-dependent attenuator is placed in series with the amplifier. The attenuator is designed such that a temperature change that causes the gain of the amplifier to increase will simultaneously cause the attenuation of the attenuator to increase such that the overall gain of the amplifier-attenuator system remains relatively constant. However, prior art temperature-dependent attenuators do not offer the bandwidth needed for certain wideband applications.

SUMMARY OF THE INVENTION

The present invention solves these and other problems by providing a wideband temperature-dependent attenuator that uses four or more temperature-dependent resistors in shunt across a transmission line and a temperature-dependent resistor in series with the transmission line. The attenuator can be used at radio frequencies, microwave frequencies, etc. In one embodiment, the temperature-dependent radio-frequency attenuator includes a plurality of temperature-dependent resistors electrically in parallel between a transmission line and ground. The parallel resistors are separated by sections of transmission line or by a resistor in series with the transmission line. In one embodiment, the shunt resistors are spaced approximately one-quarter wavelength apart at a desired frequency. The temperature coefficients of the resistors are configured such that the attenuator changes attenuation at a desired rate with changes in temperature. In one embodiment, the VSWR remains at a desirably low level to reasonable level to reduce unwanted reflections. In one embodiment, the VSWR is better than 2.0 to 1.

In one embodiment, the temperature-dependent attenuator includes a first temperature-dependent resistor having a first terminal provided to a first end of a first transmission line section and a second terminal provided to a first end of a second transmission line section, a second temperature-dependent resistor having a first terminal provided to a second end of the first transmission line section and a second terminal provided to ground, a third temperature-dependent resistor having a first terminal provided to the first end of the first transmission line section and a second terminal provided to ground, a fourth temperature-dependent resistor having a first terminal provided to the first end of the second transmission line section and a second terminal provided to ground, and a fifth temperature-dependent resistor having a first terminal provided to a second end of the second transmission line section and a second terminal provided to ground. At least one of the first, second, third, fourth, and fifth temperature-dependent resistors has a first temperature coefficient.

In one embodiment, the temperature-dependent attenuator has a negative temperature coefficient of resistance. In one embodiment, the temperature-dependent attenuator has a positive temperature coefficient of resistance. In one embodiment, the temperature-dependent attenuator has one or more negative temperature coefficient resistors. In one embodiment, the temperature-dependent attenuator has one or more positive temperature coefficient resistors. In one embodiment, one or more of the resistors are thin-film resistors. In one embodiment, the attenuator is symmetric about the series resistor.

In one embodiment, the temperature-dependent transmission line attenuator, includes a first resistor having a first terminal provided to a first end of a first transmission line section and a second terminal provided to a first end of a second transmission line section, a second resistor having a first terminal provided to a second end of the first transmission line section and a second terminal provided to ground, a third resistor having a first terminal provided to the first end of the first transmission line section and a second terminal provided to ground, a fourth resistor having a first terminal provided to the first end of the second transmission line section and a second terminal provided to ground, and a fifth resistor having a first terminal provided to a second end of the second transmission line section and a second terminal provided to ground, wherein at least one of the first, second, third, fourth, and fifth resistors comprises a temperature-dependent resistor.

In one embodiment, the temperature-dependent attenuator includes a first plurality of resistors in parallel with a first transmission line, the first plurality of resistors separated by quarter-wave sections of the first transmission line, wherein at least one resistor in the first plurality of resistors comprises a first temperature-dependent resistor, a second plurality of resistors in parallel with a second transmission line, the first plurality of resistors separated by quarter-wave sections of the second transmission line, wherein at least one resistor in the second plurality of resistors comprises a second temperature-dependent resistor, and a series resistor provided in series between the first transmission line and the second transmission line.

In one embodiment, the attenuator uses a microstrip transmission line. In one embodiment, the attenuator uses a stripline transmission line. In one embodiment, the attenuator uses a co-planar waveguide transmission line. In one embodiment, the attenuator uses a grounded co-planer waveguide transmission line. In one embodiment, the attenuator uses a coaxial transmission line. In one embodiment, the VSWR remains below 3 to 1 over a desired frequency band.

DETAILED DESCRIPTION

Figure 1:
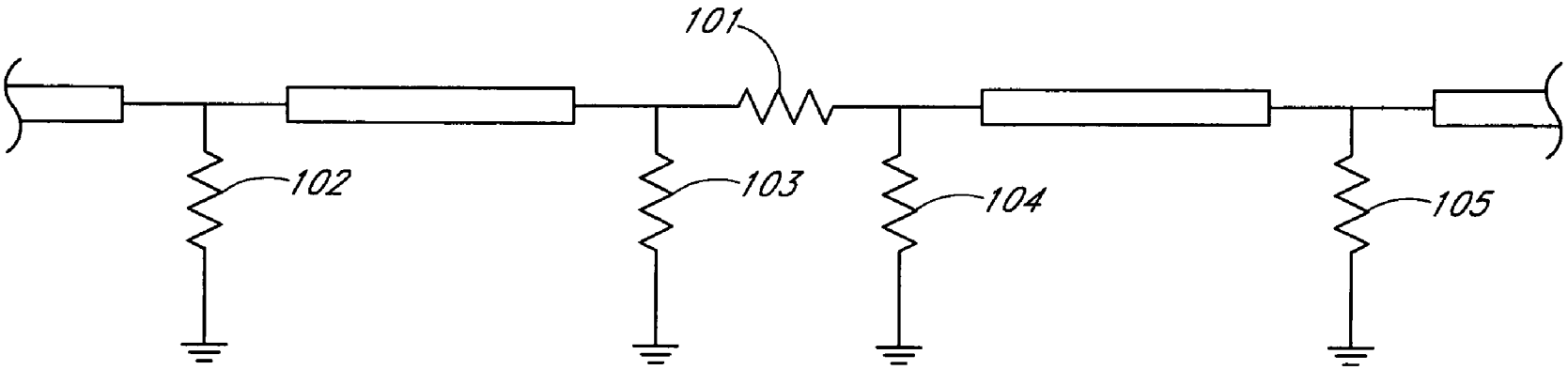
FIG. 1 is a schematic representation of a wideband attenuator with four parallel resistors and one series resistor.

FIG. 1 is a schematic representation of a wideband absorptive attenuator 100 that includes five resistors 101–105 and two transmission line sections 107, 108. The resistor 101 is provided in series between the transmission line section 107 and the transmission line section 108. A first terminal of the resistor 102 is provided to a first end of the transmission line section 107. A second terminal of the resistor 102 is provided to ground. A first terminal of the resistor 103 is provided to a second end of the transmission line section 107. A second terminal of the resistor 103 is provided to ground. A first terminal of the resistor 104 is provided to a first end of the transmission line section 108. A second terminal of the resistor 104 is provided to ground. A first terminal of the resistor 105 is provided to a second end of the transmission line section 108. A second terminal of the resistor 105 is provided to ground. A first terminal of the resistor 101 is provided to the second end of the transmission line section 107. A second terminal of the resistor 101 is provided to the first end of the transmission line section 108. An input transmission line 106 is provided to the first end of the transmission line section 107. An output transmission line 109 is provided to the second end of the transmission line section 108.

In one embodiment, the resistors 101–105 are thick-film resistors. The transmission line section 107 is one-quarter wavelength long at a first desired center frequency. The transmission line section 108 is one-quarter wavelength long at a second desired center frequency. In one embodiment, the first desired center frequency is the same as the second desired center frequency. In one embodiment, one or more of the resistors 101–105 are temperature-dependent resistors (thermistors), where the resistance of each thermistor varies with temperature according to a temperature coefficient. In one embodiment, the resistors 102 and 105 have approximately the same resistance and temperature coefficient. In one embodiment, the resistors 103 and 104 have approximately the same resistance and temperature coefficient. FIG. 1 shows four shut resistors 102–105 for purposes of illustration. One of ordinary skill in the art will recognize that five or more shunt resistors separated by transmission line sections can be used.

In one embodiment, the transmission line sections 107 and 108 have the same characteristic impedance. In one embodiment, the characteristic impedance of the transmission line sections 107 and 108 is different than the characteristic impedance of the transmission lines 106 and 109. In one embodiment, the transmission lines 106–109 have substantially the same or similar characteristic impedance.

One of ordinary skill in the art will recognize that additional transmission line sections can be added. Thus, for example, one or more transmission line sections can be added between he transmission line 106 and the transmission line 107 and/or between the transmission line 108 and the transmission line 109. In addition, additional shunt resistors can be added. Thus, for example, a number of shunt resistors separated by sections of transmission line can be provided on each side of the series resistor 101. In one embodiment, the shunt resistors are separated by quarter-wave sections of transmission line. In one embodiment, the attenuator is symmetric about the resistor 101 (e.g., the resistors 102 and 105 have approximately the same resistance and emperature coefficient, the resistors 103 and 104 have approximately the same resistance and temperature coefficient, and the transmission line sections 107 and 108 have approximately the same length and characteristic impedance).

The attenuator 100 behaves as a lossy transmission line, as the resistors 101–105 absorb a portion of the energy propagating between the transmission line 106 and the transmission line 109. The resistors 101–105 will typically produce undesired reflections on the transmission lines 106 or 109. By making the transmission line sections 107 and 108 one quarter wavelength long at a desired frequency, the reflections from the resistors will cancel at the desired center frequency, and will tend to cancel in a band around the desired center frequency. Thus the resistors 102 and 105 improve the bandwidth of the attenuator 100 as the reflections on the transmission lines 106 and 109 will be reduced or eliminated in a relatively wide band about the desired center frequency.

In one embodiment, standard microwave filter design techniques are used to design the attenuator by selecting the parameters that do not vary with frequency (e.g., the number of resistors, the lengths and impedances of the transmission lines, etc.), and then determining the resistor values at a number of temperatures to match the desired attenuation-temperature profile over the desired bandwidth. Once the resistances at a number of temperatures are known, the temperature coefficients of each resistor are selected to produce the desired temperature profile in each resistor.

In one embodiment, the resistors 101–105 are thick film resistors are produced by inks combining a metal powder, such as, for example, bismuth ruthenate, with glass frit and a solvent vehicle. This solution is deposited and then fired onto a ceramic substrate which is typically alumina but could also be beryllia ceramic, aluminum nitride, diamond, etc. When the resistor is fired, the glass frit melts and the metal particles in the powder adhere to the substrate, and to each other. This type of a resistor system can provide various ranges of material resistivities and temperature characteristics can be blended together to produce many different combinations.

The resistive characteristics of a thick film ink is specified in ohms-per-square (Ω/□). A particular resistor value can be achieved by either changing the geometry of the resistor or by blending inks with different resistivity. The resistance can be fine-tuned by varying the fired thickness of the resistor. This can be accomplished by changing the deposition thickness and/or the firing profile. Similar techniques can be used to change the temperature characteristics of the ink.

The temperature coefficient of a resistive ink defines how the resistive properties of the ink change with temperature. A convenient definition for the temperature coefficient of the resistive ink is the Temperature Coefficient of Resistance (TCR) often expressed in parts per million per degree Centigrade (PPM/C). The TCR can be used to calculate directly the amount of shift that can be expected from a resistor over a given temperature range. Once the desired TCR for a particular application is determined, it can be achieved by blending appropriate amounts of different inks. As with blending for sheet resistance, a TCR can be formed by blending two inks with TCR's above and below the desired TCR. One additional feature of TCR blending is that positive and negative TCR inks can be combined to produce large changes in the resulting material.

Some thermistors exhibit a resistance hysteresis as a function of temperature. If the temperature of the resistor is taken beyond the crossover point at either end of the hysteresis loop, the resistor will retain a memory of this condition. As the temperature is reversed, the resistance will not change in the same manner observed prior to reaching the crossover point. In one embodiment, to avoid this problem, the inks used in producing a temperature variable attenuator are selected with crossover points that are beyond the −55 deg. C. to 125 deg. C. operating range.

Figure 2:
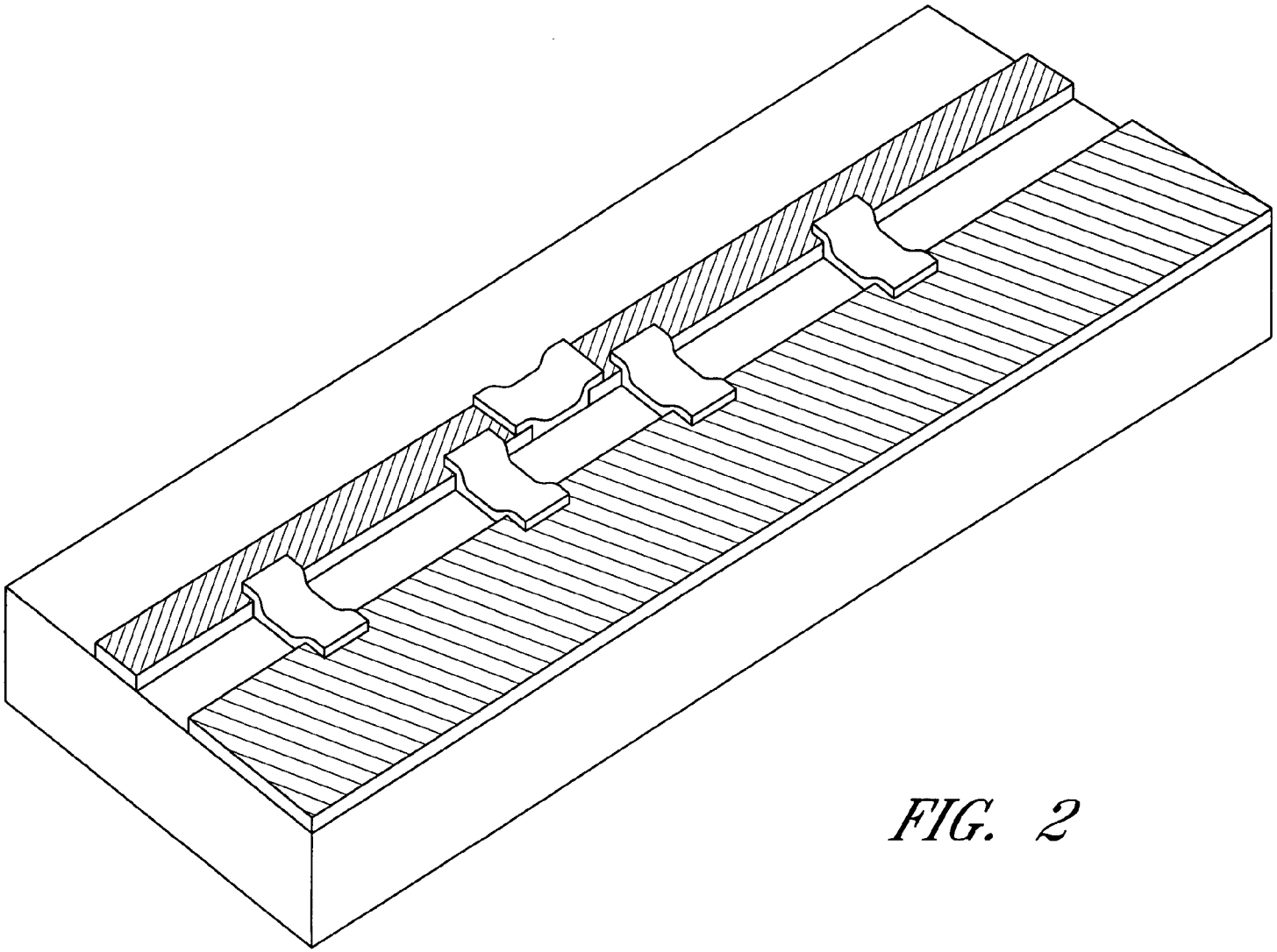
FIG. 2 is a perspective drawing of a wideband attenuator represented by the schematic of FIG. 1.

FIG. 2 shows one embodiment of attenuator construction wherein a substrate 211 is provided as a base. The substrate can be an insulating material such as, for example, aluminum oxide, aluminum nitride, diamond, Teflon, reinforced Teflon, fiberglass board or beryllia ceramic, etc. The resistors 101–105 are provided as thick-film resistors 201–205. A transmission line section 207 is provided between the resistors 202 and 203. A transmission line section 208 is provided between the resistors 204 and 205. The transmission line sections 207 and 208 are one quarter wavelength long at a desired center frequency. A co-planar ground plane 210 is provided to the grounded terminals of the resistors 202–205. width of the resistor 201 is similar to the width of the transmission line sections 207 and 208 to reduce inductive effects.

In one embodiment, the transmission line sections are made from thick film platinum gold which is deposited on the substrate 211. Thick film resistors 201–205 having the specifications described above and of the desired width and length are then formed. In one embodiment, the resistors 201–205 are then protected by a silicone protective coating 222.

The present invention may be embodied in other specific forms without departing from the spirit or essential attributes thereof and accordingly reference should be made to the appended claims rather than to the foregoing specification as indicating the scope of the invention. For instance, the transmission line sections and the thermistors can be deposited by thin film techniques without departing from the spirit or function of the present invention.

What is claimed is:

1. A temperature-dependent radio-frequency attenuator, comprising:

a first temperature-dependent resistor having a first terminal provided to a first end of a first transmission line section and a second terminal provided to a first end of a second transmission line section;

a second temperature-dependent resistor having a first terminal provided to a second end of said first transmission line section and a second terminal provided to ground;

a third temperature-dependent resistor having a first terminal provided to said first end of said first transmission line section and a second terminal provided to ground;

a fourth temperature-dependent resistor having a first terminal provided to said first end of said second transmission line section and a second terminal provided to ground;

a fifth temperature-dependent resistor having a first terminal provided to a second end of said second transmission line section and a second terminal provided to ground, wherein at least one of said first, second, third, fourth, and fifth temperature-dependent resistors has a first temperature coefficient configured such that said attenuator changes attenuation at a controlled rate with respect to changes in temperature;

a third transmission line section, wherein a first end of said third transmission line section is provided to said second end of said second transmission line section, and wherein a first terminal of a sixth temperature-dependent resistor is provided to a second end of said third transmission line section and a second terminal is provided to ground; and wherein a characteristic impedance of said third transmission line section is different from a characteristic impedance of said second transmission line section.

2. The temperature-dependent radio-frequency attenuator of claim 1, wherein said first temperature coefficient comprises a negative temperature coefficient of resistance.

3. The temperature-dependent radio-frequency attenuator of claim 1, wherein said first temperature coefficient comprises a positive temperature coefficient of resistance.

4. The temperature-dependent radio-frequency attenuator of claim 1, wherein said first temperature coefficient comprises a positive temperature coefficient of resistance and at least one of said first, second, third, fourth, and fifth temperature-dependent resistors has a negative temperature coefficient of resistance.

5. The temperature-dependent radio-frequency attenuator of claim 1, wherein at least one of said first, second, third, fourth, and fifth temperature-dependent resistors comprises thick-film resistors.

6. The temperature-dependent radio-frequency attenuator of claim 1, wherein said first temperature-dependent resistor comprises a printed ink resistor.

7. The temperature-dependent radio-frequency attenuator of claim 1, wherein said attenuator has a negative temperature coefficient of attenuation.

8. The temperature-dependent radio-frequency attenuator of claim 1, wherein said attenuator has a positive temperature coefficient of attenuation.

9. The temperature-dependent radio-frequency attenuator of claim 1, wherein said first transmission line section comprises a microstrip transmission line.

10. The temperature-dependent radio-frequency attenuator of claim 1, wherein said first transmission line section comprises a stripline transmission line.

11. The temperature-dependent radio-frequency attenuator of claim 1, wherein said transmission line comprises a co-planar waveguide transmission line.

12. The temperature-dependent radio-frequency attenuator of claim 1, wherein said transmission line comprises a grounded co-planer waveguide transmission line.

13. The temperature-dependent radio-frequency attenuator of claim 1, wherein said transmission line comprises a coaxial transmission line.

14. The temperature-dependent radio-frequency attenuator of claim 1, wherein a VSWR remains below 3 to 1 over a desired frequency band.

15. The temperature-dependent radio-frequency attenuator of claim 1, further comprising an input transmission line provided to said first transmission line section.

16. The temperature-dependent radio-frequency attenuator of claim 1, wherein a resistance of said second temperature-dependent resistor is approximately equal to a resistance of said fifth temperature-dependent resistor.

17. The temperature-dependent radio-frequency attenuator of claim 1, wherein a resistance of said third temperature-dependent resistor is approximately equal to a resistance of said fourth temperature-dependent resistor.

18. The temperature-dependent radio-frequency attenuator of claim 1, wherein said attenuator is symmetric.

* * * * *